United States Patent [19]

Kemeny

[11] 4,319,168

[45] Mar. 9, 1982

[54] MULTISTAGE ELECTROMAGNETIC ACCELERATOR

[75] Inventor: George A. Kemeny, Wilkins Township, Allegheny County, Pa.

[73] Assignee: Westinghouse Electric Corp., Pittsburgh, Pa.

[21] Appl. No.: 116,118

[22] Filed: Jan. 28, 1980

[51] Int. Cl.[3] ..... H02K 41/02

[52] U.S. Cl. ..... 318/135; 310/12; 124/3; 124/54; 104/282

[58] Field of Search ..... 318/135, 687; 310/12, 310/13; 124/3, 54; 104/282, 298

[56] References Cited

U.S. PATENT DOCUMENTS 3,904,941 9/1975 Matsui et al. ..... 104/290 X 3,912,992 10/1975 Lamb ..... 318/135

OTHER PUBLICATIONS

"The Rail Gun Installation", by R. A. Marshall, Australian National University, Canberra, ACT, 2600, Australia.

*Primary Examiner*—B. Dobeck

*Attorney, Agent, or Firm*—F. J. Baehr, Jr.

[57] ABSTRACT

A multistage electromagnetic accelerator in which energy is serially induced in stages of parallel rail having serially segmented segments or stages utilizing a high DC current source, circuit breakers, and induction coils with both primary and secondary windings to produce ultra high exit velocity in an armature and projectile which are slidably disposed between the parallel rails.

28 Claims, 7 Drawing Figures

MULTISTAGE ELECTROMAGNETIC ACCELERATOR

BACKGROUND OF THE INVENTION

This invention relates to electromagnetic accelerators for accelerating a projectile and more particularly to such an accelerator having multistages. Electromagnetic accelerator devices such as described hereinafter utilize very high currents to provide high acceleration of a projectile armature during the entire period the projectile armature is in contact with parallel conductive rails. Circuitry is shown which, accomplishes staged current injection into the rails, provides high average current keeping the acceleration force relatively constant and increases the efficiency by reducing the energy which must be wasted when the projectile armature is expelled from the last stage.

SUMMARY OF THE INVENTION

In general an electromagnetic accelerator, when made in accordance with this invention, comprises a pair of generally parallel conductive rails, a device or devices for supplying high DC current to the rails at a plurality of locations along the rails, an armature slidably engaging the rails, and current interrupting means cooperating with the current supplying means to supply current to successive portions of the rails as the armature is accelerated and as it travels from one end of the rails to the other.

BRIEF DESCRIPTION OF THE DRAWINGS

The object and advantages of this invention will become more apparent by reading the following detailed description in connection with the accompanying drawings, in which.

DESCRIPTION OF THE PREFERRED EMBODIMENTS

Figure 1:
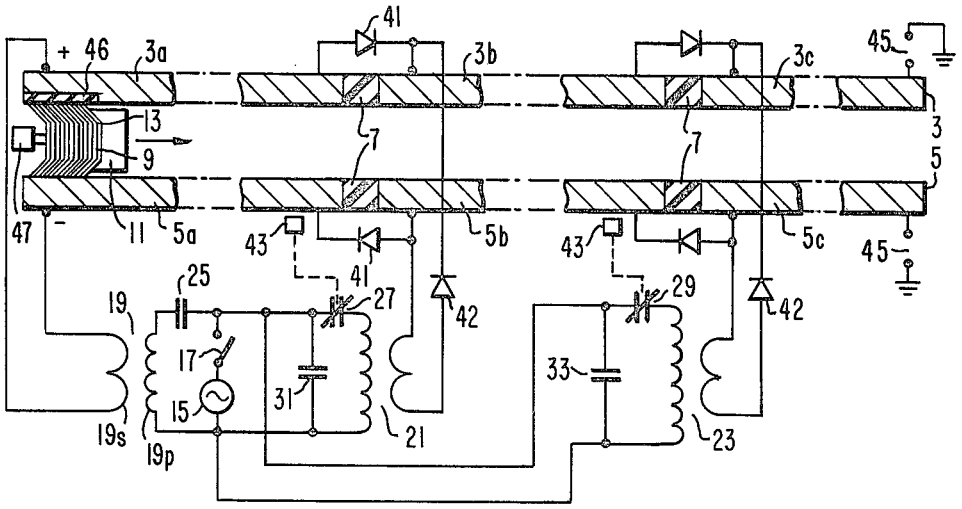
FIG. 1 is a schematic diagram of a multistage electromagnetic accelerator made in accordance with this invention.

Referring now to the drawings in detail and in particular to FIG. 1, there is shown a schematic diagram of a multistage electromagnetic accelerator comprising a pair of generally parallel conductors or conductive rails 3 and 5. Each conductor or conductive rail is segmented, that is, it is made up of conductive segments 3*a*, 3*b* and 3*c* and 5*a*, 5*b* and 5*c* separated by insulation 7. Slidably disposed between the rails 3 and 5 is a projectile armature 9 or other means for carrying or conducting current between the rails as establishing an arc by utilizing initially a shooting wire or other means and a projectile 11, which may be propelled by the armature or arc. The projectile armature 9 is made up of a stack of conductive sheets 13, which have margins that contact the rail and are bent toward the trailing end of the armature 9.

A homopolar generator, DC generator or AC generator with rectifying means or any other means for producing a high DC current 15 is connected in series with a make switch 17, and a plurality of mutual induction coils 19, 21 and 23 having a primary coil 19*p*, 21*p*, and 23*p*, respectively, and secondary coils 19*s*, 21*s*, and 23*s*, respectively. Preferably, the primary and secondary coils are so wound that they both substantially link all their magnetic flux. The primary coils 19*p*, 21*p*, and 23*p* each have a circuit breaker or other means for interrupting a circuit 25, 27, and 29, respectively, connected in series therewith. The primary coils 19*p*, 21*p*, and 23*p* and their respective circuit breaker means 25, 27, and 29 are connected in parallel across the generating means 15 and make switch 17. Current shorting or crowbarring means 31 and 33 are respectively connected across the primary coils 21*p* and 23*p* and circuit breaker means 27 and 29. It being understood that the make switch 17, circuit breaking means 25, 27, and 29, and current crowbarring means 31 and 33 may be any type of switching device capable of closing and/or opening circuits in which large DC currents flow and that the different names are utilized to make it easier to describe the circuit and its operation.

The secondary coils 19*s*, 21*s*, and 23*s* have one end thereof, respectively, connected to the rail segments 3*a*, 3*b*, and 3*c* and the other end thereof, respectively, connected to the rail segments 5*a*, 5*b*, and 5*c* so that the rail 3 is arbitrarily positive and rail 5 is negative. Rectifying means 41 is connected across the insulator 7 so that the current generally flows in one direction in rail 3 and generally in the opposite direction in rail 5. Rectifying means 42 are disposed in the leads connecting the secondary coils 21*s* and 23*s* to the conductive rails 3*b* and 3*c*, respectively. Armature or arc sensors 43 are suitably disposed in the vicinity of the trailing end of the rails 5*a* and 5*b* to sense the armature 9 or the arc as it approaches the trailing end of these rail segments and send signals to the circuit breaking means 27 and 29 as the armature 9 approaches the trailing end of the respective rail segments 5*a* and 5*b*. The sensor 43 may be optical or electrical or mechanical or a combination thereof. Its function is to synchronize the opening of the circuit breaking means 27 and 29 as the armature 9 progresses to the next rail segment. A spark gap or other energy dissipating means 45 is disposed on the trailing end of the rail segments 3*c* and 5*c* to dissipate the energy remaining in the rails after the projectile 11 has been ejected therefrom.

While both rails 3 and 5 are shown to be segmented and have insulators 7 disposed between the segments, the operation would not be impaired if only one rail was segmented with insulator 7 disposed between the segments or, to produce a more modular or symmetrical configuration, the insulating gap in each rail could be staggered so that each rail is insulated at every second stage thus reducing the number of gaps and the number of bridging circuits which generally include the rectifying means 41. The insulating gap in the rails are generally shorter than the armature 9 so that current can start to flow through the armature 9 between the next successive rail segments before current flow is interrupted across the trailing portions of the previous rail segments so as to reduce arcing as the armature 9 moves across the insulating gap. If an arc is utilized to drive the projectile rather than an armature, short insulating gaps would assist the establishment or transposition of the arc to successive rail segments.

The operation of the multistage electromagnetic accelerator shown in FIG. 1 is as follows: a prime mover (not shown) brings the rotor of the generating means 15 to the desired velocity thus initially storing kinetic energy therein, the switch 17 is then closed with the circuit breaking means 25, 27, and 29 already closed and the circuit crowbarring means 31 and 33 open. This allows current to flow into the primary coils 19*p*, 21*p*, and 23*p*. The current is allowed to build up to predetermined levels, which substantially transfers the kinetic energy of the generating means 15 to electromagnetic energy temporarily stored in the primary coils 19*p*, 21*p*, and 23*p*. The current crowbarring means 31 and 33 are next closed temporarily storing the energy in the coils 19*p*, 21*p*, and 23*p*. While crowbarring means are not shown across the coil 19*p* and current breaker 25, if resistance through the generating means or current conducting buses is high, crowbarring means should be utilized. During the period energy is being transferred to the primary coils 19*p*, 21*p* and 23*p*, relatively low voltage will be produced across the terminals of the secondary coils 19*s*, 21*s* and 23*s*. To prevent undesirable energy dissipation and the possibility of premature launching during this period, an insulating strip 46 is disposed between the conductive rail 3*a* and the armature 9. A pneumatic, hydraulic, mechanical, explosive, electromagnetic or other initiating device 47 may be utilized to move the armature 9 beyond the insulating strip 46 and initiate acceleration. Alternatively the insulation 46 could be a material which would break down when the voltage reached predetermined level or the armature and projectile would be inserted at first the desired time between conductive portions of the rails to initiate acceleration. The circuit breaker 25 is opened transferring current from the primary coil 19*p* to the secondary coil 19*s*. Since the number of turns in the secondary coil 19*s* is generally substantially less than the number of turns in the primary coil 19*p*, the electromagnetic energy transferred to the secondary coil 19*s* produces a higher current in the secondary coil 19*s* and this current is directed to the rails 3*a* and 5*a* and armature 9 applying an electromagnetic force to accelerate the armature 9 and projectile 11 along the rails 3*a* and 5*a*. When the armature 9 approaches the insulator 7 between the rail 5*a* and 5*b* the sensor 43 initiates opening of the circuit breaker 27 transferring current from the primary coil 21*p* to the secondary coil 21*s* and to the rails 3*b* and 5*b* thus injecting current into the rails to accelerate the armature 9 and projectile 11 as it travels along the rails 3*b* and 5*b*. As the armature 9 approaches the insulator between the rail 5*b* and 5*c* the sensor 43 adjacent thereto sends a signal to open the circuit breaker 29 transferring current from the primary coil 23*p* to the secondary coil 23*s* and to the rails 3*c* and 5*c* injecting energy into these rails to continue to accelerate the armature 9 and projectile 11. The rectifying means 41 allows the forward flow of current from one set of rails to the next successive set of rails, but prevents any flow of current back from newly energized rails. As the projectile 11 and armature 9 are ejected from the rails the energy dissipating means 45 drains the remaining energy from the rails 3 and 5 preventing arcing between the rails, as the energy remaining in the rails is still sufficiently high to produce arcing, if not drained in some manner.

Figure 2:
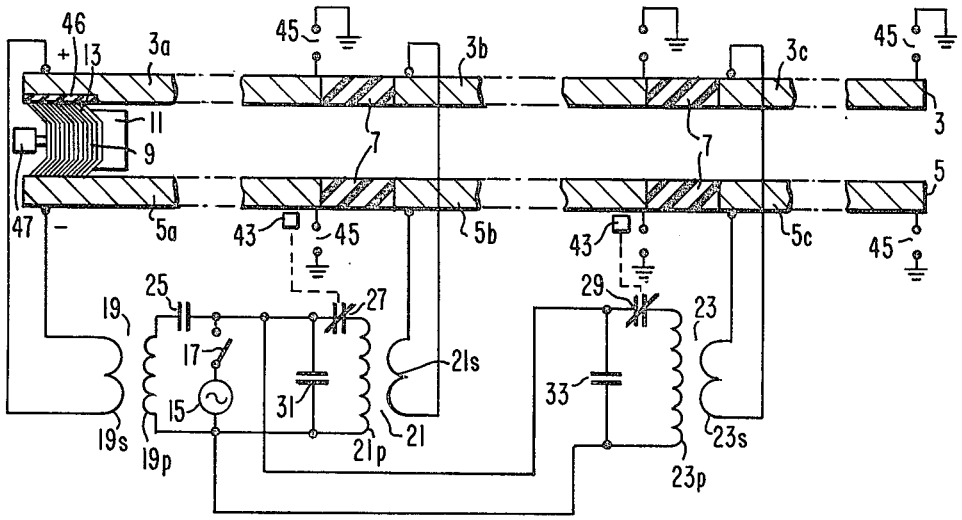
FIGS. 2 through 4 are schematic diagrams of alternative embodiments having segmented rails.

FIG. 2 shows a schematic diagram similar to FIG. 1 except there is no rectifying means between adjacent rail segments and there is energy dissipating means 45 at the end of each rail segment to dissipate the energy in each segment as the armature passes beyond that segment. In this embodiment the insulators 7 are preferably longer than the armature 9.

Figure 3:
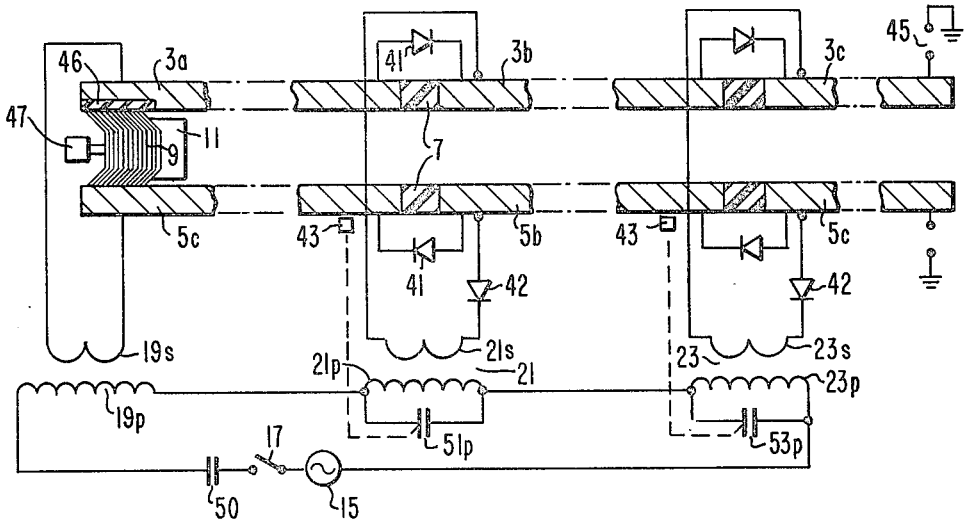

FIG. 3 shows a schematic diagram in which the segmented rails 3*a*, *b*, and *c* and 5*a*, *b*, and *c*, the insulator 7, the armature 9, and the projectile 11 are similar to those shown in FIGS. 1 and 2, however the circuitry of the power supply is different. A similar generating means 15 and make switch 17 is utilized, however the primary portions of the mutual inductance coils 19*p*, 21*p*, and 23*p* are connected in series with the generating means 15 and make switch 17 and a current interrupting means 50. Circuit breakers 51*p* and 53*p* are connected respectively across the primary coils 21*p* and 23*p*. The secondary coils 19*s*, 21*s*, and 23*s* are respectively connected to the leading ends of the rails 3*a*, *b*, and *c* and 5*a*, *b*, and *c*. Rectifying means 41 are disposed across the insulator 7, rectifying means 42 are disposed in the leads connecting the secondary coils 21*s* and 23*s* to the conductive rails 5*b* and 5*c*, respectively, and energy dissipating means 45 are disposed adjacent the trailing end or muzzle of the rails segments 3 and 5*c*.

The operation of the multistage electromagnetic accelerator as shown in FIG. 3 is as follows: the rotor of the generation means 15 is brought to the desired speed by a prime mover (not shown) or by motoring up and when the desired rotor kinetic energy magnitude is attained, the make switch 17 and interrupter means 50 are closed thus commencing current flow in the series circuit including the primary coils 19*p*, 21*p*, and 23*p*. When the current reaches a predetermined level the circuit breakers 51*p* and 53*p* connected respectively across the primary coils 21*p* and 23*p* are closed temporarily storing energy in these coils and the armature 9 is concurrently moved beyond the insulating strip 46 by the initiating device 47. The interrupter means 50 is opened, transferring the electromagnetic energy stored in the primary coil 19*p* to the secondary coil 19*s* accelerating the armature 9 over the rail segment 3*a* and 5*a*. As the armature 9 approaches the second rail segment 3*b* and 5*b* the circuit breaking means 51*p* opens, as the sensor 43 associated therewith responds to the approach of the armature, transferring energy from the primary coil 21*p* to the secondary coil 21*s* and to the rail segments 3*b* and 5*b* accelerating the armature 9 along the rail segments 3*b* and 5*b*. Similarly, as the armature 9 approaches the third rail segments 3*c* and 5*c*, the circuit breaker 53*p* opens, as the sensor 43 associated therewith responds to the approach of the armature 9, transferring electromagnetic energy from the primary coil 23*p* to the secondary coil 23*s* and the rail segments 3*c* and 5*c* to accelerate the armature 9 through the final rail segments 3*c* and 5*c*. Energy dissipating means 45 prevent arcing as the armature 9 is ejected from the rail segments 3*c* and 5*c* and rectifying means 41 transfer current from one rail segment to the next rail segment and to the armature 9 or are as the projectile 11 progresses along the rails.

Figure 4:
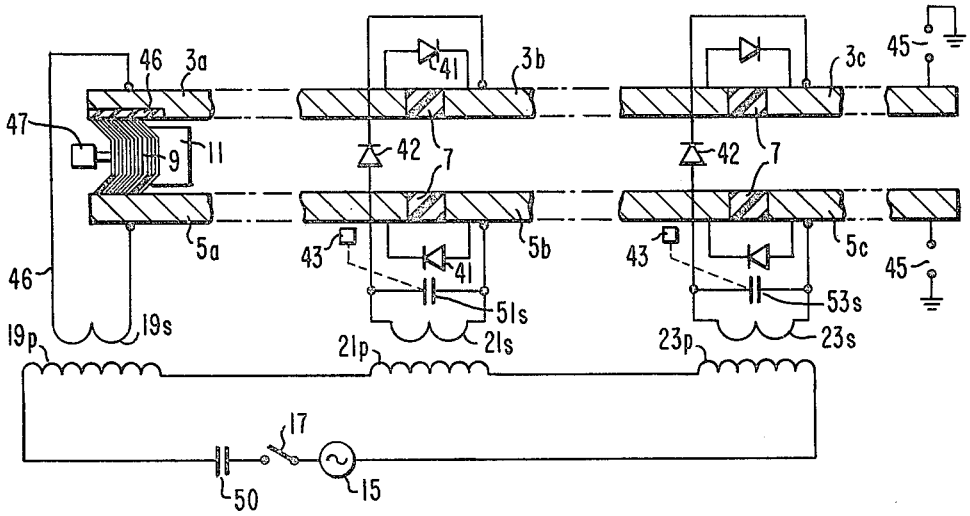

FIG. 4 shows a schematic diagram of a multistage electromagnetic accelerator similar to the one shown in FIG. 3 except the circuit breakers 51*s* and 53*s* are connected across the secondary coils 21*s* and 23*s*, respectively, and the circuit breakers 51*p* and 53*p* are omitted across the primary coils 21*p* and 23*p* respectively.

The operation of the multistage electromagnetic accelerator shown in FIG. 4 is as follows: the prime mover (now shown) brings the rotor of the generating means 15 to the speed level at which the kinetic energy required for launching is attained. The make switch 17 is closed along with the current interrupting means 50. The make switch 17 can be eliminated as the circuit interrupter 50 can also serve this function. The primary coils 19*p*, 21*p*, and 23*p* are connected in series with the generating means 15, the make switch 17 and the current interrupter means 50. When a predetermined current is reached in the series circuit hereinbefore described, the circuit breakers 51*s* and 53*s* disposed across the secondary coils 21*s* and 23*s*, respectively, are closed and the armature 9 is moved beyond the insulating strip 46 by the initiating device 47. The circuit interrupter 50 is opened transferring energy from the primary induction coils 19*p*, 21*p*, and 23*p* to the secondary coils 19*s*, 21*s*, and 23*s*. The energy in the coils 21*s* and 23*s* is temporarily stored and the current in the secondary coil 19*s* is conducted to the rails 3*a* and 5*a* and accelerates armature 9 and projectile 11. As the sensor 43 adjacent the trailing end of the rail 5*a* senses the approach of the armature 9, the circuit breaker 51*s* opens delivering energy to the rails 3*b* and 5*b* accelerating the armature 9 as it passes therealong. And in a like manner as the armature 9 is sensed by the sensor 43 disposed at the trailing end of the rail 5*b*, the circuit breaker 53*s* is opened transferring energy to the rails 3*c* and 5*c* accelerating the armature therealong. As the armature exists from the rails 3*c* and 5*c* the energy dissipating means 45 removes the energy from the rails and prevents arcing therebetween. The rectifying means 41 and 42 allow the current to flow forward to the newly activated rails and help to prevent a backward flow of current as the successive secondary coils energize the successive rail segments.

Figure 5:
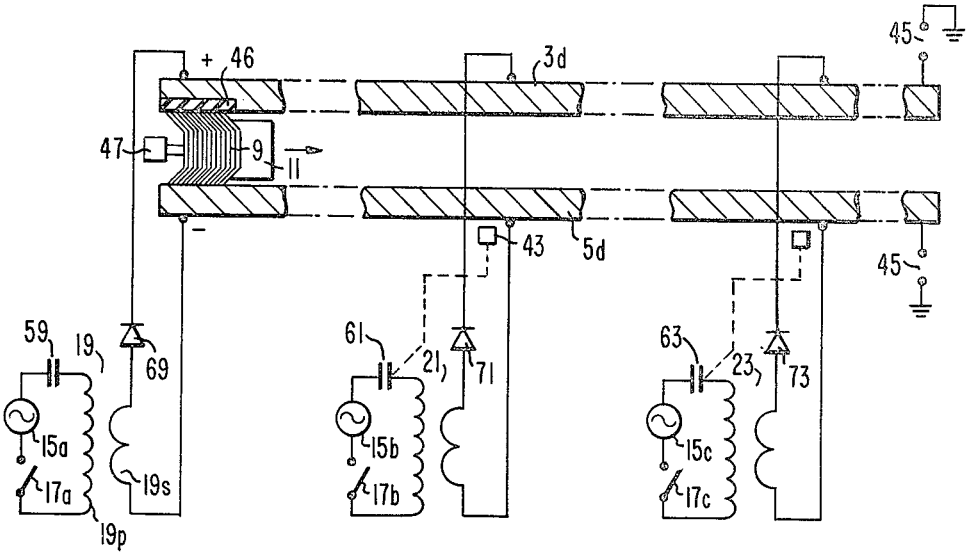
FIGS. 5 and 6 are schematic diagrams of alternative embodiments having continuous rails.

FIG. 5 shows a schematic diagram of a multistage electromagnetic accelerator, which comprises continuous rails 3*d* and 5*d* which are utilized to accelerate an armature 9 or an arc, and projectile 11 disposed thereon. A plurality of generating means 15*a*, *b*, and *c* are connected in series respectively with switches 17*a*, *b*, and *c*, circuit breaker means 59, 61, and 63 and the primary coils 19*p*, 21*p*, and 23*p* of the mutual inductance coils 19, 21, and 23. Secondary coils 19*s*, 21*s*, and 23*s* have rectifying means 69, 71, and 73 respectively connected in series therewith and are connected to the rails 3*d* and 5*d* at various intervals along their length. Energy dissipating means 45 are connected to the trailing ends of the rails 3*d* and 5*d* to prevent arcing therebetween after exit of the projectile.

The operation of the multistage electromagnetic accelerator shown in FIG. 5 is as follows: after the desired level of kinetic energy has been transferred to each of the generating means 15*a*, 15*b* and 15*c*, the switches 17*a*, *b*, and *c* are closed along with the circuit breakers 59, 61 and 63. The generating means 15*a*, *b*, and *c* produce a predetermined current in the respective circuits temporarily storing energy in the primary coils 19*p*, 21*p*, and 23*p*. The armature 9 is next moved beyond the insulating strip 46 by the initiating device 47. The circuit breaker 59 is opened transferring energy from the primary coil 19*p* to the secondary coil 19*s* and the rails 3*d* and 5*d* to accelerate the armature 9 or an arc formed between rails. As the armature 9 approaches the location on the rails 3*d* and 5*d* near where the secondary coil 21*s* is connected thereto, the circuit breaker 61 is opened transferring energy from the primary coil 21*p* to secondary coil 21*s* and the rails 3*d* and 5*d* as the sensor 43 picks up the approach of the armature 9. The rectifier means 69 and 71 cooperate with the circuit now formed with the armature 9 and rails 3*d* and 5*d* to assure that current flows only in the desired directions and to prevent or reduce parasitic current flow. As the armature 9 approaches that portion of the rail 3*d* and 5*d* near where the secondary coil 23*s* is connected, the sensor 43 associated with the circuit breaking means 63 sends a signal to the circuit breaking means 63 to open the circuit, which transfers the electromagnetic energy stored in the primary coil 23*p* to the secondary coil 23*s* and also to the connected portions of the rails 3*d* and 5*d* to continue accelerating the armature 9 until the armature exists from the rails. Energy dissipating means 45 prevents arcing between the rails and dissipates the energy remaining therein.

Figure 6:
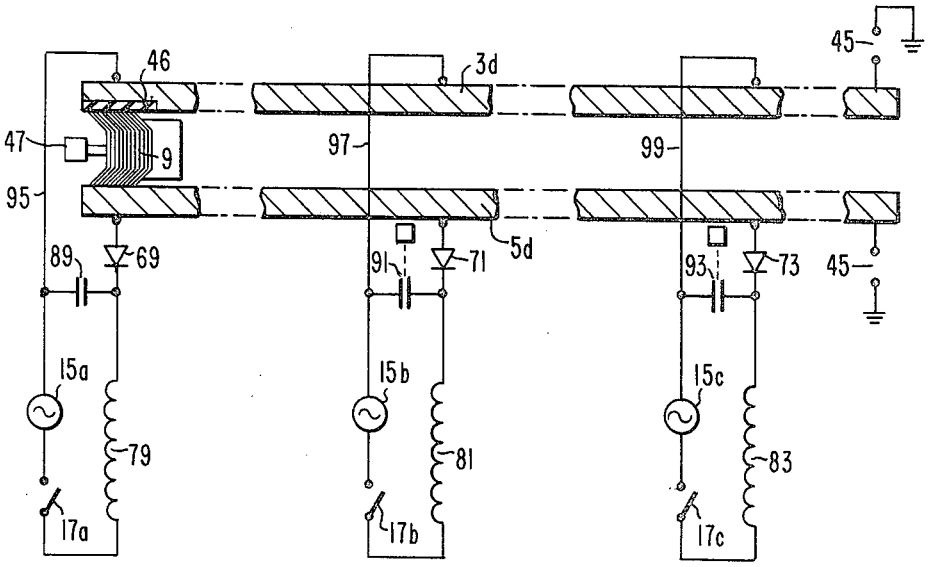

FIG. 6 shows a schematic diagram of a multistage electromagnetic accelerator having continuous rails 3*d* and 5*d*, and armature 9, and projectile 11. A plurality of generating means 15*a*, *b*, and *c* are, respectively, connected in series with the make switches 17*a*, *b*, and *c*; induction coils 79, 81, and 83; and the circuit breakers 89, 91, and 93 forming a close loop. The rail 3*d* is connected to one side of the circuit breaker means 89, 91, and 93 at various locations along its length and the rail 5*d* is connected to the other side of the circuit breaker means 89, 91, and 93 at corresponding locations along its length. Rectifier means 69, 71 and 73 arc are, respectively, connected in one of the leads connecting the circuit breaker means 89, 91 and 93 to the rail 3*d* or 5*d*. Energy dissipating means 45 are connected to the discharge end of the rails 3*d* and 5*d* to prevent arcing between the rails as the armature 9 or projectile driving arc exits therefrom. Sensors 43 operate the circuit breakers 91 and 93.

The operation of the electromagnetic accelerator shown in FIG. 6 is as follows: the generating means 15*a*, *b*, and *c* produce a DC current which flows through the induction coils 79, 81, and 83 when the switches 17*a*, *b*, and *c* and the circuit breakers 89, 91, and 93 are closed temporarily storing electromagnetic energy in the coils 79, 81, and 83. In order to restrain the armature 9 in its initial position leads 95, 97, and 99 connect one side of the circuit breaking means 89, 91, and 93 respectively to the rail 3*d* and these leads 95, 97 and 99 may have sufficient resistance so that any parasitic and premature current flow produced by the minor voltages across breakers 89, 91 and 93 during charging of inductors 79, 81 and 83 will not cause sufficient current flow through armature 9 to cause premature launch or excessive armature heating. Premature armature 9 launching may also be prevented by an insulating means 46 disposed between the armature and the rail and the armature could be initially moved from the insulating means 46 by pneumatic, hydraulic, electromagnetic or mechanical initiating means 47. Upon opening the circuit breaker 89, energy stored in the induction coil 79 is transferred to the rails 3*d* and 5*d* initiating acceleration of the armature 9. As the armature 9 progresses down the rails 3*d* and 5*d*, the sensor 43 initiates opening of the circuit breaker 91 transferring energy stored in the induction coil 81 to the rails 3*d* and 5*d* as the armature passes the electrical junction connecting the induction coil to the rails and accelerates the armature. When the armature approaches the electrical juncture of leads to the induction coil 83 the sensor 43 associated therewith opens the circuit breaker 93 injecting energy into the rails 3*d* and 5*d* to provide additional acceleration. The serial injection of power into the rails maintains a more constant acceleration and reduces the resistance and inductance losses of the system. The rectifying means 69, 71, and 73 prevent a parasitic flow of current from one source to the other, but they still allow the earlier stages to transfer a greater portion of their energy to the armature 9 to help maintain the high acceleration. As the armature 9 leaves the rails 3*d* and 5*d* the energy dissipating means 45 discharges the rails and prevents arcing between the rails.

As shown in the drawings the rectifying means 42 are disposed in the secondary or high current portions of the circuits. Present day commercially available rectifiers may be utilized in parallel and if required, series-parallel connected arrays to handle these high currents. Since the duration of the current flow is very short, the individual rectifiers can be safely operated at high current levels thus reducing the number of rectifiers required for the high accelerating current. The rectifying means 42 prevents parasitic current flow in the secondary portions of the circuits and the rectifying means 41 prevents reversal of current between adjacent rail segments if a subsequent current injection circuit is activated prematurely before the armature reaches the associated rail segments. Thus, in FIGS. 1, 3 and 4 synchronization of current injection into the successive rail segments is not extremely critical. Whereas the circuits in FIGS. 5 and 6 must absolutely preclude premature current injection to successive rail segments or this would result in current flowing in the wrong direction through the armature 9 or driving arc which may produce acceleration forces in the wrong direction or produce other undesirable results. Late current injection into successive rail segments of any of the embodiments would result in less efficient utilization of available energy and may produce excessive rail currents.

Figure 7:
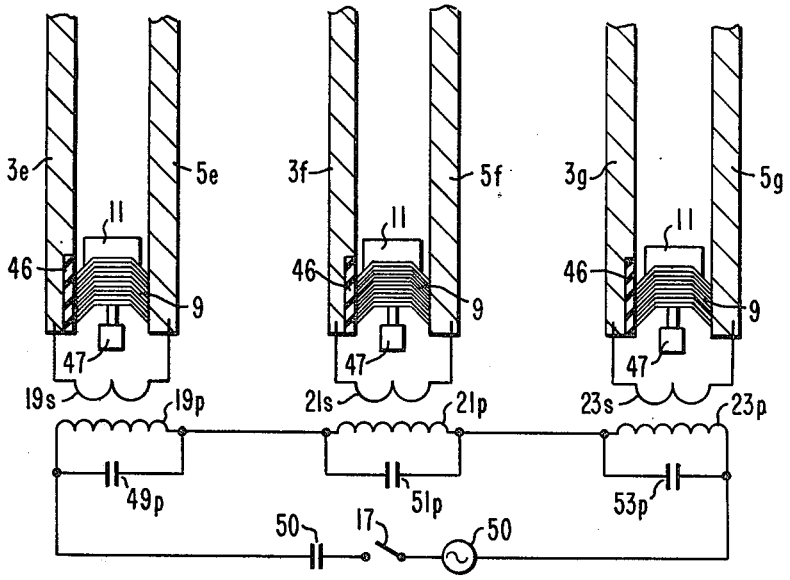
FIG. 7 is a schematic diagram of an alternative embodiment which facilitates multiple firing.

The circuits shown in FIGS. 1 through 4 could be utilized for multiple projectile launching by replacing the rail segments with individual pairs of rail having a projectile 11 and an arc drive or armature 9 to conduct current between the rails in each pair and to accelerate the projectiles. Rectifying means and some of the circuit breakers or crowbar switches may also be eliminated. FIG. 7 shows how the circuit shown in FIG. 3 could be utilized. The secondary coils 19*s*, 21*s* and 23*s* could be connected to the rails 3*f* and *g*, and 5*e*, *f* and *g* respectively. An additional circuit breaker 49*p* could be electrically connected across the primary coil 19*p* or the circuit breakers 49*p*, 51*p* and 53*p* could be eliminated. Insulating strips 46 and means 47 for moving the armature beyond the insulating strips are shown, however any device will suffice which will insert the armature or be utilized to establish an arc just between the rails when the circuit breakers 50, 49*p*, 51*p* and 53*p* are opened to initiate firing.

If the circuit breakers 49*p*, 51*p* and 53*p* are utilized 3 projectiles can be accelerated in rapid succession, without the circuit breakers 49*p*, 51*p* and 53*p* three projectiles would be accelerated essentially simultaneously. If the primary coils 19*p*, 21*p* and 23*p* are connected in parallel across the DC source 15 successive or simultaneous firing could be achieved.

It should be observed that the crowbarring means 31 and 33 in FIGS. 1 and 2 need not always be required because the current change in storage coils 21*p* and 23*p* will be relatively slow when these coils have attained near their maximum current levels and therefore even without crowbarring, energy may be stored for a few milliseconds in these coils as long as their current flow loops are of sufficiently low resistance to prevent excessive energy loss.

Even though FIGS. 5 and 6, both of which utilize continuous rails, are shown with a separate power supply for each of the individual accelerating current injection locations, it should be observed that the current supply systems shown in FIGS. 1, 3 and 4 may also be used with continuous rails but when so used, it would be advantageous to add a rectifier means 42 into the initial rail firing circuit.

If the projectile is to be arc driven, it is required to initiate the arc which is normally accomplished by having a fuse means bridge across the initial or breech rail sections at the time when current flow is first injected there. When the fuse means explodes, an arc is initiated which pushes against and accelerates an insulating member. This member serves at least two functions. It must, first, seal the inner rail bore to prevent the arc or hot gases from bypassing the projectile and it must as its second function push the projectile unless the insulating member is also the projectile.

The multistage electromagnetic accelerators hereinbefore described: advantageously utilize primary and secondary storage coils at each inductive energy storage location to allow switching at lower current levels, to simplify and reduce the cost of producing adequate switching hardware; allows the use of stored energy injection from a number of optimally located separate induction energy storage locations with energy initially supplied by a single or multiple energy sources to produce an ideal injection of energy into parallel rails in order to maintain a relatively constant acceleration force along the entire length of the rail, allows use of individual stage energy storage for ultra high velocity propulsion; allows energy remaining in the inductive stores and rails to be usefully utilized in accelerating the projectile even after the projectile has passed beyond the rail section initially powered by that particular inductive storage coil; allows greater efficiency or energy utilization because energy in a preceding stage is usefully dissipated in accelerating the projectile rather than being wasted; allows reduction in the energy to be dissipated at the muzzle after projectile exit and thus increases life and/or reduces complexity of the muzzle energy dissipation means; reduces the length of rail, which at any given instant experiences maximum current flow and thus reduces rail ohmic heating and ohmic heating losses; allows the individual stage, high current, inductive energy sources to be located close to the location where the high current is required, thus obviating the expense and high energy loss associated with transmitting ultra high current over longer distances; allows using a single initial energy source, which transmits power in the form of relatively low current to a number of separate locations where the current level is then increased to the magnitude required for electromagnetic launching.

What is claimed is:

1. An electromagnetic accelerator comprising generally parallel conductive rails having separate rail segments along their length;

a DC current source;

a plurality of induction coils having a primary portion and a secondary portion;

a make switch connected in series with the DC current source;

circuit breaker means including separate circuit breaker means connected in series with each primary portion of each induction coil;

the separate circuit breaker means and primary portion of the induction coils being connected in parallel across the make switch and DC current source;

the secondary portion of each induction coil being connected to the leading end of the separate rail segments;

means for conducting current between said rails; and said current source and said circuit breaker means cooperating with said induction coils to supply current to serial segments of the rails as said means for conducting current between said rails is accelerated and traverses from one end of said rails to the other.

2. An electromagnetic accelerator as set forth in claim 1 and further comprising current crowbarring means electrically connected across at least one circuit breaker and primary portion of the associated induction coil.

3. An electromagnetic accelerator as set forth in claim 1 and further comprising rectifier means electrically connecting adjoining rail segments to allow current flow in one direction only.

4. An electromagnetic accelerator as set forth in claim 1 and further comprising energy dissipating means connected to the trailing end of the last rail segment.

5. An electromagnetic accelerator as set forth in claim 1 and further comprising energy dissipating means connected to the trailing end of each rail segment.

6. An electromagnetic accelerator as set forth in claim 1 and further comprising sensor means disposed to respond to the approach of the current conducting means to operate associated circuit breaker means.

7. An electromagnetic accelerator as set forth in claim 1 and further comprising rectifying means disposed in one of the leads connecting the secondary portion of at least one induction coil to the conductive rails.

8. An electromagnetic accelerator as set forth in claim 1, wherein the means for conducting current between the conductive rails is an armature slidably engaging the conductive rails.

9. An electromagnetic accelerator as set forth in claim 1, wherein the means for conducting current between the conductive rails is an arc established between the conductive rails.

10. An electromagnetic accelerator comprising generally parallel conductive rails having separate rail segments along their length;

a DC power source;

a plurality of induction coils having a primary and secondary portion, said primary portion being connected in series with said power source and the secondary portion being connected to serial segments of the conductive rails;

circuit breaker means comprising a circuit breaker means connected in series with the power supply and the primary portion of the induction coils, and circuit breaker means connected across a portion of at least one of the induction coils;

means for conducting current between said rails;

sensing means responding to the approach of the means for conducting current between the rails to actuate the circuit breaking means connected across a portion of at least one of the induction coils; and said power source and said circuit breaker means cooperating with said induction coils to supply current to serial segments of the rails as said means for conducting current between said rails is accelerated and traverses from one end of said rails to the other.

11. An electromagnetic accelerator as set forth in claim 10 and further comprising rectifying means disposed across the insulators disposed between rail segments.

12. An electromagnetic accelerator as set forth in claim 10, wherein the circuit breaker means across at least one is disposed across the primary portion of at least one induction coil.

13. An electromagnetic accelerator as set forth in claim 10, wherein the circuit breaker means across at least one induction coil is disposed across the secondary portion of at least one induction coil.

14. An electromagnetic accelerator as set forth in claim 12 and further comprising energy dissipating means disposed at the trailing end of the last rail segment.

15. An electromagnetic accelerator as set forth in claim 13 and further comprising energy dissipating means disposed at the trailing end of the last rail segment.

16. An electromagnetic accelerator as set forth in claim 10, wherein the means for conducting current between the conductive rails is an armature slidably engaging the conductive rails.

17. An electromagnetic accelerator as set forth in claim 10, wherein the means for conductng current between the conductive rails is an arc established between the conductive rails.

18. An electromagnetic accelerator comprising generally parallel conductive rails;

a plurality of DC power sources;

a plurality of induction coils having a primary portion and a secondary portion;

circuit breaking means comprising a plurality of circuit breaking means;

each power source having one of the circuit breaker means and one of the primary portions of the induction coil connected in series therewith and forming a closed circuit;

a plurality of rectifying means each secondary portion of the induction coils having one of the rectifying means connected in series there th; and the secondary portion of each induction coil and rectifying means being connected to the conductive rails at a plurality of locations therealong;

means for conducting current between said rails; and said power sources, said rectifying means, and said circuit breaker means cooperating with said induction coils to supply current to serial locations along the rails as said means for conducting current between said rails is accelerated and traverses from one end of said rails to the other.

19. An electromagnetic accelerator as set forth in claim 18 and further comprising sensing means disposed to respond to the means for conducting current between rails as it approaches the location where the secondary portion of the induction coil is connected to the conductive rail to actuate the associated circuit breaker means.

20. An electromagnetic accelerator as set forth in claim 19 and further comprising energy dissipating means disposed at the trailing end of the conductive rails.

21. An electromagnetic accelerator comprising generally parallel conductive rails;

a DC power source;

a plurality of induction coils;

circuit breaker means comprising a plurality of circuit breakers; and a plurality of rectifying means;

each power source having an induction coil and one of the circuit breakers, connected in series therewith and forming a closed circuit; and leads connected across each circuit breaker means connecting each side of the circuit breaker means to a conductive rail, the various circuit breaking means being connected to serial locations along the rail rails, one of the rectifier means being disposed in a lead connecting the circuit breaker means to the rails;

means for conducting current between said rails; and said power source, said rectifying means and said circuit breaker means cooperating with said induction coils to supply current to serial locations along the rails as said means for conducting current between said rails is accelerated and traverses from one end of said rails to the other.

22. An electromagnetic accelerator as claimed in claim 21 and further comprising sensing means disposed to respond to the current conducting means as it approaches the location where the leads are connected to the conductive rail to actuate the circuit breaker means.

23. An electromagnetic accelerator as set forth in claim 21 and further comprising energy dissipating means disposed at the trailing end of the conductive rails.

24. An electromagnetic accelerator comprising:

a plurality of parallel conductive rails arranged in pairs;

means for conducting current between the rails in each pair;

a DC current source;

circuit breaker means; and a plurality of inductive coils having a primary and a secondary portion, the primary portions being connected to the DC source and the circuit breaker means and a secondary portion being connected to each pair of conductive rails;

said current source and said circuit breaker means cooperating with said induction coils to supply current to said rails to accelerate said means for conducting current between each pair of rails from one end of each pair of rails to the other.

25. An electromagnetic accelerator as set forth in claim 24, wherein the means for conducting current between the rails is an armature.

26. An electromagnetic accelerator as set forth in claim 24, wherein the means for conducting a current between rails is an arc.

27. An electromagnetic accelerator as set forth in claim 24, wherein the circuit braking means are disposed in a circuit in which all of the primary coils are connected to the DC source.

28. An electromagnetic accelerator as set forth in claim 24, wherein circuit breaking means is connected across each primary portion of each induction coil.

* * * * *